US006054242A

United States Patent [19]

Okutani et al.

[11] Patent Number: 6,054,242

[45] Date of Patent: Apr. 25, 2000

[54] ELECTROPHOTOGRAPHIC TONER

[75] Inventors: Haruo Okutani; Tsutomu Kurokoshi, both of Shizuoka, Japan

[73] Assignee: Tomogawa Paper Co., Ltd., Japan

[21] Appl. No.: 09/354,088

[22] Filed: Jul. 15, 1999

[30] Foreign Application Priority Data

Jul. 16, 1998 [JP] Japan ..... 10-216569
May 14, 1999 [JP] Japan ..... 11-133926

[51] Int. Cl.[7] ..... G03G 9/097
[52] U.S. Cl. ..... 430/110; 430/109
[58] Field of Search ..... 430/109, 110

[56] References Cited

U.S. PATENT DOCUMENTS 3,938,992 2/1976 Jadwin et al. ..... 430/107
5,427,881 6/1995 Sacripante et al. ..... 430/109
5,567,563 10/1996 Minami ..... 430/111

FOREIGN PATENT DOCUMENTS 3-31858 2/1991 Japan ..... 430/109

*Primary Examiner*—Roland Martin
*Attorney, Agent, or Firm*—Weneroth, Lind & Ponack, L.L.P.

[57] ABSTRACT

An electrophotographic toner excellent in fixing properties at a low temperature, resistance to offsetting and shelflife and suitable for a heat-fixing method can be provided by an electrophotographic toner containing, as a binder, a polyester resin having a carbodiimide crosslink or an electrophotographic toner containing a carbidiimide-crosslinked polyester resin and a low melting point compound having a melting initiation temperature of 60 to 100° C.

14 Claims, No Drawings

ELECTROPHOTOGRAPHIC TONER

FIELD OF THE INVENTION

The present invention relates to an electrophotographic toner used in an electrophotography method, an electrostatic recording method and an electrostatic printing method. More specifically, it relates to an energy-saving type electrophotographic toner that is excellent in resistance to offsetting, shelflife and fixing properties at a low temperature and suitable for a heat-fixing method.

PRIOR ARTS OF THE INVENTION

In an electrophotography method, an electrostatic recording method and an electrostatic printing method, an electrostatic image formed on an electrostatic image substrate is made visible by using toner particles obtained by dispersing a colorant, or the like, in a resin. This visible image is directly fixed on the electrostatic image substrate or is transferred to another substrate and then fixed. The heat fixing method of toner images includes a non-contact heating method such as an oven fixing and a contact heating method using a heat roller fixing. In recent years, a low energy fixing and speed-up of a fixing step are required. Thus, the latter method is mainly used since it has advantages that a toner image can be fixed at a low power consumption due to high thermal efficiency and that an apparatus can be miniaturized. However, this method has a problem of an occurrence of offsetting phenomenon. The term "offsetting phenomenon" refers to a phenomenon in which part of a toner forming an image transfers to a heating roller surface at a fixing time and the transferred toner transfers onto a next transfer sheet to be fed, to make an fixed image dirty. When a glass transition temperature is decreased for fixing at a low temperature, there is a blocking problem that a toner as a powder is mutually fused during storage. That is, electrophotographic toners that can be fixed at low temperatures and are excellent in resistance to offsetting and shelflife are required under the present circumstances. Various suggestions have been made in conventional arts for satisfying these requirements and have gone into actual use.

One suggestion is an attempt to fix a toner at low temperatures by using a binder resin having a low molecular weight as a binder resin to be incorporated into the toner. However, when a toner, obtained by conventional arts, using a vinyl-containing resin such as a styrene resin or an acrylic resin has a low molecular weight, the toner becomes fragile and a stress in a developing apparatus causes the pulverization of the toner and the fusing of the toner to a carrier and a sleeve. When used for a long period of time, the deterioration of an image is unavoidable due to the variation of chargeabililty.

On the other hand, when a condensation type resin, represented by a polyester resin, having a low molecular weight is used, the melting point decreases but the viscosity decreases at the same time. And, there is caused a problem of the occurrence of an offsetting phenomenon on a fixing roll. For preventing this problem, a crosslinked structure that broadens the molecular weight distribution of a polyester resin is introduced. In this method, the molecular weight distribution is broadened by crosslinking and the offsetting phenomenon can be inhibited, while fixing properties at a low temperature deteriorates due to the conversion of the molecular weight as a whole to high molecular weight. Therefore, it is unavoidable to decrease the glass transition temperature (Tg, hereinafter) of a resin for fixing at a low temperature. In this case, blocking occurs during storage and it is impossible to satisfy shelflife. As described above, the toners of conventional arts can not accomplish fixing properties at low temperatures concurrently with satisfying resistance to offsetting and shelflife.

SUMMARY OF THE INVENTION

It is an object of the present invention to provide an electrophotographic toner which satisfies resistance to offsetting and shelflife and further satisfies fixing properties at low temperatures.

It is another object of the present invention to provide an energy-saving type electrophotographic toner which satisfies the above properties and is suitable for a heat fixing method.

According to the present invention, there is provided an electrophotographic toner containing at least a binder and a colorant, wherein the binder contains a carbodiimide-crosslinked polyester resin.

According to the present invention, the carbodiimide-crosslinked polyester resin is a polyester resin having a crosslinked structure based on the reaction of a polyester resin with a carbodiimide compound having in its molecule a carbodiimide group shown by the following formula, $$-N=C=N-.$$

According to the present invention, the polyester resin is a resin obtained from a divalent alcoholic component and at least one component selected from the group consisting of a divalent carboxylic acid, its acid anhydride and its lower alkyl ester.

According to the present invention, the polyester resin further contains at least one component selected from the group consisting of a polyvalent alcohol having 3 or more valence, a polyvalent carboxylic acid having 3 or more valence, its acid anhydride and its lower alkyl ester.

According to the present invention, the polyester resin having a crosslinked structure is obtained by incorporating 0.1 to 50 parts by weight of the carbodiimide compound per 100 parts by weight of the polyester resin.

According to the present invention, there is provided an electrophotographic toner containing at least a binder and a colorant, wherein the toner contains the carbodiimide-crosslinked polyester resin recited above and a low melting point compound having a melting initiation temperature of 60 to 100° C.

According to the present invention, the low melting point compound is waxes and/or a thermoplastic resin.

According to the present invention, the toner contains 1 to 40 parts by weight of the low melting point compound per 100 parts of the polyester resin.

DETAILED DESCRIPTION OF THE INVENTION

The electrophotographic toner of the present invention uses a carbodiimide-crosslinked polyester resin. The "carbodiimide-crosslinked polyester resin" refers to a polyester resin having a crosslinked structure, which is obtained by reacting a carbodiimide compound having a carbodiimide group in a molecule with a polyester resin. The polyester resin is characterized in that it is formed of at least a divalent alcoholic component and a component of a divalent carboxylic acid, its acid anhydride or its lower alkyl ester and optionally at least one component selected from components of a polyvalent alcohol having 3 or more valence, a polyvalent carboxylic acid having 3 or more valence, its acid anhydride and its lower alkyl ester.

The divalent alcoholic component used for the polyester resin of the present invention includes diethanol amine, ethylene glycol, diethylene glycol, propylene glycol, isoprene glycol, octanediol, 2,2-diethyl-1,3-propanediol, spiroglycol, neopentyl glycol, 1,3-butanediol, 1,4-butanediol, 2-butyl-2-ethyl-1,3-propanediol, 1,6-hexanediol, hexylene glycol, 1,5-pentanediol, 3-methyl-1,5-pentanediol, hydrobenzoin, bis(β-hydroxyethyl) terephthalate, bis(hydroxylbutyl)terephthalate, polyoxyethylene-modified bisphenol A, polyoxypropylene-modified bisphenol A, polyoxyethylene-modified biphenol and polyoxypropylene-modified biphenol.

The divalent carboxylic acid component includes fumaric acid, maleic acid, succinic acid, itaconic acid, mesaconic acid, citraconic acid, glutaconic acid, phthalic acid, isophthalic acid, terephthalic acid, cyclohexanedicarboxylic acid, cyclohexenedicarboxylic acid, adipic acid, sebacic acid, dodecanoic diacid, 1,12-dodecanedicarboxylic acid, eicosane diacid, azelaic acid, brazil acid, naphthalenedicarboxylic acid, biphenyl-4,4-dicarboxylic acid, 2,3-piperazine-dicarboxylic acid, iminodicarboxylic acid, imidazole-4,5-dicaboxylic acid, piperidine dicarboxylic acid, pyrazoledicarboxylic acid, N-methyl pyrazoledicarboxylic acid, N-phenyl pyrazoledicarboxylic acid, pyridinedicarboxylic acid, carbazole-3,6-dicarboxylic acid, 9-methyl carbazole-3,6-dicarboxylic acid, carbazole-3,6-dibutanoic acid, carbazole-3,6-γ, γ'-diketobutanoic acid, acid anhydrides of these and lower alkyl esters of these.

The polyvalent alcoholic component having 3 or more valence includes sorbitol, 1,2,3,6-hexanetetrol, 1,2,6-hexanetriol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane and 1,3,5-trihydroxybenzen.

The polycarboxylic acid component having 3 or more valence includes trimellitic acid, 1,2,4-cyclohexanetricarboxylic acid, 1,2,4-naphthalenetricarboxylic acid, 2,5,7-naphthalenetricarboxylic acid, pyridinetricarboxylic acid, pyridine-2,3,4,6-tetracarboxylic acid, 1,2,7,8-tetracarboxylic acid and butanetetracarboxylic acid. Acid anhydrides of these and lower alkyl esters of these may be used.

The carbodiimide compound used in the present invention is a compound having a carbodiimide group in a molecule. This compound reacts with a carboxyl group of the polyester resin to form a carbamoylamide bond and reacts with a hydroxyl group of the polyester resin to form an isourea bond. Further, the polycarbodiimide resin obtained from the carbodiimide compound used in the present invention can be prepared from an isocyanate compound as a raw material by decarbonation-condensation which proceeds at a reaction temperature of 120 to 150° C. under pressure in the presence of a carbodiimide-converting catalyst such as 3-methyl-1-phenyl-2-phospholeneoxide or 1-phenyl-2-phospholene-1-oxide. Further, the polycarbodiimide resin can be also prepared by dissolving an isocyanate compound as a raw material in an aliphatic acetate-containing solvent, a halogen-containing solvent or an alicyclic ether solvent in the presence of the above carbodiimide-converting catalyst and carrying out decarbonation-condensation.

The isocyanate compound as a raw material for producing a polycarbodiimide compound includes n-butyl isocyanate, tert-butyl diisocyanate, iso-butyl isocyanate, ethyl isocyanate, n-propyl isocyanate, iso-propyl isocyanate, cyclohexyl isocyanate, n-octadecyl isocyanate, 2,4-toluylene diisocyanate, 2,6-toluylene diisocyanate, o-toldine diisocyanate, 4,4'-diphenylmethane diisocyanate, 4,4'-dicyclohexylmethane diisocyanate, 4,4'-diphenyl ether diisocyanate, 3,3'-dimethoxy-4,4'-biphenyl diisocyanate, p-phenylene diisocyanate, naphthylene-1,5-diisocyanate, m-xylylene diisocyanate, hydrogenated-xylylene diisocyanate, m-tetramethylxylylene diisocyanate, p-tetramethylxylylene diisocyanate, hexamethylene diisocyanate, trimethylhexamethylene diisocyanate and isophorone diisocyanate.

The polycarbodiimide resin obtained from the above raw materials includes polytert-butylcarbodiimide, polytetramethylxylylenecarbodiimide, poly-2,4-toluylenecarbodiimide, poly-2,6-toluylenecarbodiimide, poly-o-toldinecarbodiimide, poly-4,4-diphenylmethanecarbodiimide, poly-4,4'-dicyclohexylmethanecarbodiimide, poly-4,4'-diphenyl ether carbdiimide, poly-3,3'-dimethoxy-4,4'-diphenyl ether carbodiimide, poly-p-phenylenecarbodiimide, polynaphthylene-1,5-carbodiimide, poly-m-xylylenecarbodiimide, poly-hydrogenated xylylene carbodiimide, polyhexamethylenecarbodiimide, polytrimethylhexamethylene carbodiimide and polyisophorone carbodiimide.

The low melting point compound used in the present invention has a melting initiation temperature of 60 to 100° C., at which temperature a plunger starts to move downward under the following measurement conditions with the following measuring apparatus.

Measuring apparatus: Koka type flow tester CF-500 supplied by Shimadzu Corporation Measurement conditions:

Plunger: 1 $cm^2$

Diameter of die: 1 mm

Length of die: 1 mm

Load: 20 kgF

Temperature for preliminary heating: 50~80° C.

Time for preliminary heating: 300 seconds

Temperature elevation rate: 6° C./minute

The low melting point compound used in the present invention shall not be specially limited so long as it has a melting initiation temperature of 60 to 100° C., measured by the above method. However, it includes ester waxes such as carnauba wax, rice wax, candelilla wax, vegetable wax, jojoba oil, beeswax, lanoline, montan wax, ozokerite, ceresin, soybean hardened oil, rapeseed hardened oil and castor hardened oil, olefin waxes such as polyethylene, polypropylene, Fischer-Tropsch wax, α-olefin/maleic anhydride and/or a maleic anhydride ester copolymer, petroleum waxes such as paraffin wax, micro wax and petrolatum and resins such as a linear polyester resin, a nonlinear polyester resin, a styrene/acrylate resin, a polyamide resin and a polyimide resin. In accordance with the conversion of a toner to a low viscosity toner, the fixing strength of the toner is improved. Of the above examples, therefore, the low melting point compound of the present invention is preferably an ester wax, α-olefin maleic anhydride and/or a maleic anhydride ester copolymer, as an olefin wax, and a linear polyester resin.

<Synthesis methods of a polyester resin and a linear polyester resin>

The polyester resin used in the present invention uses, as raw materials, a divalent alcoholic component, a component of a divalent carboxylic acid, its acid anhydride or its lower alkyl ester, and optionally a component of a polyvalent alcohol having 3 or more valence, a polyvalent carboxylic acid having 3 or more valence, its acid anhydride and its lower alkyl ester. The polyester resin used in the present invention can be obtained by placing these raw materials in a four-necked, round bottom flask equipped with a stirrer, a condenser and a nitrogen gas-introducing tube and condensation polymerizing the mixture at a temperature of 180 to 260° C. while introducing a nitrogen gas. In some cases, the pressure in the reaction system is reduced to a vacuum of 10 mmHg or less for accelerating the reaction, as required. In the reaction, an esterification catalyst such as zinc oxide, dibutyl tinoxide, tetrabutoxytitanate or p-toluenesulfonic acid may be used.

Further, the linear polyester resin which is a low melting point compound uses as raw materials a divalent alcoholic component and a component of a divalent carboxylic acid, its acid anhydride or its lower alkyl ester, as described above, and the linear polyester resin can be produced by the same synthetic method as that of the above polyester resin.

The polyester resin used in the present invention (excluding the linear polyester resin which is a low melting point compound) has a glass transition temperature, measured with a differential scanning calorimeter (DSC), of 50° C. or more, preferably 50 to 80° C., a melting initiation temperature, measured under the same conditions as those in the above measurement of the melting initiation temperature of the low temperature compound, of 70° C. or more, preferably 80 to 120° C., and a flow softening point of 100° C. or more, preferably 100 to 150° C., more preferably 105 to 130° C.

The term "flow softening point" refers to a middle temperature between a temperature at which a plunger starts to move downward and a temperature at which the plunger stops moving downward.

<Reaction of carbodiimide compound and polyester resin>

The carbodiimide compound reacts with an active hydrogen group. As for the polyester resin, the carbodiimide compound reacts with a carboxyl group to form a carbamoylamide bond and reacts with a hydroxyl group to form an isourea bond, whereby the resin can be crosslinked. In this case, the polyester resin preferably has an acid value and a hydroxyl value in the range of from 3 mgKOH/g to 100 mgKOH/g, more preferably from 5 mgKOH/g to 60 mgKOH/g. When the acid value and the hydroxyl value are lower than the lower limit of the above range, undesirably, the crosslinking reaction of the polyester resin with the carbodiimide compound is insufficient and the resistance to offsetting at high temperatures as a toner can not be obtained. Reversely, when the acid value and the hydroxyl value are higher than the upper limit of the above range, undesirably, and not only the crosslinking density becomes too high and the fixing strength is therefore deteriorated but also the number of functional groups contained in resin increases and the chargeability are therefore unstable. Further, the amount of the carbodiimide compound is preferably 0.1 part by weight to 50 parts by weight, more preferably 0.5 part by weight to 30 parts by weight, the most preferably 1 part by weight to 20 parts by weight, per 100 parts by weight of the polyester resin. When the amount of the carbodiimide compound is lower than the lower limit of the above range, the crosslinking reaction by the carbodiimide compound is insufficient and the resistance to offsetting at high temperatures as a toner can not be obtained. Reversely, when the amount of the carbdiimide compound is larger than the upper limit of the above range, the resistance to offsetting is improved but the melt viscosity after the crosslinking reaction undesirably becomes too high and the fixing strength as a toner therefore deteriorates. <Crosslinking method with carbodiimide and incorporation method of low melting point compound>

Fundamentally, the carbodiimide-crosslinked polyester resin of the present invention may be produced with any apparatus so long as it can set a temperature required for the carbodiimide-crosslinking reaction and carry out the reaction of the polyester resin and the carbodiimide compound. For example, a carbodiimide compound is added into a four-necked flask used in the synthesis of a polyester resin concurrently at the time of incorporating monomers for the synthesis of a polyester resin, or a carbodiimide compound is later added during the synthesis of a polyester resin. Otherwise, a carbodiimide compound is added in the toner-conversion step of mixing a synthesized polyester resin with a colorant and other additives with a super mixer. And, the resultant mixture is melt-kneaded under heat in a kneader, whereby a kneaded mixture may be obtained. The low melting point compound may be added in the same manner as in the addition of the carbodiimide compound.

An electrophotographic toner can be directly obtained by pulverizing the obtained kneaded mixture with a jet mill and then classifying it with a dry-method flush classifier. The melt-kneader used for the melt-kneading includes a single-screw kneader, a twin-screw kneader, an extruder, a roller mixer, a Banbury mixer and a pressure kneader. In the present invention, the term "polyester resin" includes a polyester resin that is co-polymerized with other polymerizable monomers having an active hydrogen group, such as a carboxyl group, a hydroxyl group or a amino group, which accompanies the reaction with a carbodiimide compound. Further, the polyester resin may be used as a mixture with other resins. As the "other resins", a resin such as polyetherpolyol, acrylpolyol, epoxypolyol, a polyacrylic acid, a polyamide resin, a styrene resin, a styrene-acryl copolymer resin, a polyester resin, a polyethylene resin, an epoxy resin, a silicon resin and a polyurethane resin can be contained. However, the amount of the "other resin" should be in the range where the properties as the polyester resin having a crosslinked structure based on the reaction with a carbodiimide compound are not inhibited.

Further, the electrophotographic toner of the present invention may contain various colorants and magnetic substances other than the above resin component.

The colorant used in the present invention includes carbon black, Aniline Blue, Phthalocyanine Blue, Quinoline Yellow, Malachite Green, lamp black, rhodamine-B and quinacridone. The amount of the colorant is 1 to 20% by weight based on the resin component. As a charge control agent for positively charged toners, a nigrosine dye, ammonium salt, Pyridium salt, or azine is added in an amount of 0.1 to 10% by weight based on the resin component. Toners using a polyester resin generally give negative chargeability. When a charge control agent for negatively charged toners is added as required, a chromium complex or an iron complex is used. When the negative chargeability is too strong, a neutralization-control is possible by adding the above positively charged charge control agent.

The magnetic substances used for the electrophotographic toner of the present invention include ferrite, magnetite, ferromagnetic metals such as iron, cobalt and nickel, alloys of these metals, compounds containing these metals, alloys which contain no ferromagnetic metal but exhibit ferromagnetism when properly treated under heat, i.e., so-called Heusler alloys containing manganese and copper such as manganese-copper-aluminum alloy and manganese-copper-tin alloy, and chromium dioxide. The magnetic material is homogeneously incorporated into the resin component in a state in which the magnetic material has the form of a fine powder having an average diameter of 0.1~1 μm. The content thereof is 20 to 70 parts by weight, preferably 40 to 70 parts by weight, per 100 parts by weight of the toner.

Effect of the Invention

The electrophotographic toner of the present invention has effects that the toner has a sufficient offsetting-free temperature range, it can be fixed at low temperatures, it is excellent in fixing strength and a great number of copies having sufficient image density can be given. When used with a copying machine or a printer, the electrophotographic toner of the present invention has effects that the electric power consumption can be decreased, the machine cost can be decreased by decreasing the pressure of a roll, and the copying speed can be increased.

EXAMPLES

The present invention will be explained more in detail with reference to Synthesis Examples of a resin used in the present invention and Examples of the present invention, while the present invention shall not be limited by these Examples. In Examples, "part" stands for "part by weight".

<Synthesis of a polyester resin>

Synthesis Example 1

252.8 g (0.8 mol) of polyoxyethylene-modified bisphenol A, 68.8 g (0.2 mol) of polyoxypropylene-modified bisphenol A, 66.5 g (0.4 mol) of terephthalic acid, 66.5 g (0.4 mol) of isophthalic acid, 23 g (0.12 mol) of trimellitic anhydride and 0.05 g of dibutyltin oxide were placed in a 1-liter four-necked flask made of glass, and a thermometer, a stirrer, a cascade type condenser and a nitrogen-introducing tube were mounted on the flask. The mixture was allowed to react at a reaction temperature of 180 to 220° C. with a mantle heater for 6 hours under a nitrogen gas current. After the completion of the discharge of methanol, the pressure in the reactor was reduced to 10 Torr or less while the temperature was maintained at 220° C. After the reaction was carried out for 1 hour, Synthetic resin A was obtained. The resin had Tg, measured with DSC, of 62° C., a melting initiation temperature, measured with a flow tester, of 102° C. and a flow softening point of 128° C. Further the resin had an acid value of 18 mgKOH/g and a hydroxyl value of 25 mgKOH/g.

Synthesis Example 2

126.4 g (0.4 mol) of polyoxyethylene-modified bisphenol A, 206.4 g (0.6 mol) of polyoxypropylene-modified bisphenol A, 166.1 g (1 mol) of isophthalic acid, 20.1 g (0.15 mol) of trimethylolpropane and 0.05 g of dibutyltin oxide were placed in a four-necked flask. The synthesis was carried out in the same manner as in Synthesis Example 1, to obtain a resin B. The resin had Tg of 61° C., a melting initiation temperature of 103° C., a flow softening point of 125° C., an acid value of 5 mgKOH/g and a hydroxyl value of 45 mgKOH/g.

Synthesis Example 3

53.7 g (0.17 mol) of polyoxyethylene-modified bisphenol A, 239.2 g (0.68 mol) of polyoxypropylene-modified bisphenol A, 9 g (0.1 mol) of 1,4-butanediol, 132.9 g (0.8 mol) of terephthalic acid, 33.2 g (0.2 mol) of isophthalic acid, 42 g (0.2 mol) of trimellitic acid and 0.05 g of dibutyltin oxide were placed in a four-necked flask. The synthesis was carried out in the same manner as in Synthesis Example 1, to obtain a resin C. The resin had Tg of 63° C., a melting initiation temperature of 105° C., a flow softening point of 130° C., an acid value of 48 mgKOH/g and a hydroxyl value of 12 mgKOH/g.

Synthesis Example 4

252.8 g (0.8 mol) of polyoxyethylene-modified bisphenol A, 68.8 g (0.2 mol) of polyoxypropylene-modified bisphenol A, 166.1 g (1 mol) of terephthalic acid and 0.05 g of dibutyltin oxide were placed in a 1-liter four-necked flask made of glass. The synthesis was carried out in the same manner as in Synthesis Example 1, to obtain a resin D. The resin had Tg of 68° C., a melting initiation temperature of 86° C., a flow softening point of 102° C., an acid value of 8 mgKOH/g and a hydroxyl value of 22 mgKOH/g.

<Productions of a carbodiimide crosslinked polyester resin and a toner>

Example 1

| | |
|---|---|
| Polyester resin A obtained in Synthesis Example 1 | 50 parts |
| Carbodiimide compound ("Carbodilite HMV-8CA", supplied by NISSHINBO INDUSTRIES, INC.) | 5 parts |
| Carbon Black ("MA-100", supplied by MITSUBISHI CHEMICAL CO., LTD.) | 5 parts |
| Chromium-containing complex salt dye ("TRH", supplied by HODOGAYA CHEMICAL CO., LTD.) | 2 parts |
| Low molecular weight polypropylene ("Viscol 330P", supplied by Sanyo Chemical Industries, Ltd.) | 2 parts |

A mixture having the above components was dryblended with a table mill and crosslinked by melt-kneading it under heat at a kneading temperature of 120° C. with a batch type twin-screw kneader ("Polyabsystem Rheomix600", supplied by HAAKE), to obtain a kneaded mixture. The kneaded mixture was cooled, then pulverized and classified, to obtain negatively charged toner particles having an average particle diameter of 10 μm. 0.5 part of hydrophobic colloidal silica was externally added with a Henschel mixer to 100 parts of the toner particles, to obtain an electrophotographic toner of the present invention. The toner had Tg of 63° C., a melting initiation temperature of 105° C. and a flow softening point of 133° C.

Example 2

| | |
|---|---|
| Polyester resin B obtained in Synthesis Example 2 | 50 parts |
| Carbodiimide compound ("Carbodilite T-02", supplied by NISSHINBO INDUSTRIES, INC.) | 10 parts |
| Carbon Black ("MA-600", supplied by MITSUBISHI CHEMICAL CO., LTD.) | 5 parts |
| Chromium-containing complex salt dye ("Bontron S-44", supplied by Orient Chemical Industries, Ltd.) | 2 parts |
| Low molecular weight polypropylene ("Viscol 330P", supplied by Sanyo Chemical Industries, Ltd.) | 2 parts |

An electrophotographic toner of the present invention was obtained from a mixture having the above components in the same manner as in Example 1. The toner had Tg of 62° C., a melting initiation temperature of 104° C. and a flow softening point of 131° C.

Example 3

| | |
|---|---|
| Polyester resin C obtained in Synthesis Example 3 | 50 parts |
| Carbodiimide compound ("Carbodilite HMV-10B", supplied by NISSHINBO INDUSTRIES, INC.) | 4 parts |
| Carbon Black ("MA-100", supplied by MITSUBISHI CHEMICAL CO., LTD.) | 5 parts |
| Chromium-containing complex salt dye ("Bontron S-34", supplied by Orient Chemical Industries, Ltd.) | 2 parts |
| Low molecular weight polypropylene ("Viscol 330P", supplied by Sanyo Chemical Industries, Ltd.) | 2 parts |

An electrophotographic toner of the present invention was obtained from a mixture having the above components in the same manner as in Example 1. The toner had Tg of 65° C., a melting initiation temperature of 107° C. and a flow softening point of 138° C.

Example 4

| | |
|---|---|
| polyester resin D obtained in Synthesis Example 4 | 50 parts |
| Carbodiimide compound ("Carbodilite 10M-SP", supplied by NISSHINBO INDUSTRIES, INC.) | 15 parts |
| Carbon Black ("MA-100", supplied by MITSUBISHI CHEMICAL CO., LTD.) | 5 parts |
| Chromium-containing complex salt dye ("Bontron S-34", supplied by Orient Chemical Industries, Ltd.) | 2 parts |
| Low molecular weight polypropylene ("Viscol 330P", supplied by Sanyo Chemical Industries, Ltd.) | 2 parts |

An electrophotographic toner of the present invention was obtained from a mixture having the above components in the same manner as in Example 1. The toner had Tg of 63° C., a melting initiation temperature of 106 ° C and a flow softening point of 130° C.

Comparative Example 1

A comparative electrophotographic toner was obtained in the same manner as in Example 1 except that no carbodiimide compound was used. The toner had Tg of 61° C., a melting initiation temperature of 101° C. and a flow softening point of 122° C.

Comparative Example 2

A comparative electrophotographic toner was obtained in the same manner as in Example 2 except that no carbodiimide compound was used. The toner had Tg of 60° C., a melting initiation temperature of 100° C. and a flow softening point of 120° C.

Comparative Example 3

A comparative electrophotographic toner was obtained in the same manner as in Example 3 except that no carbodiimide compound was used. The toner had Tg of 62° C., a melting initiation temperature of 103° C. and a flow softening point of 124° C.

Comparative Example 4

A comparative electrophotographic toner was obtained in the same manner as in Example 4 except that no carbodiimide compound was used. The toner had Tg of 62° C., a melting initiation temperature of 84° C. and a flow softening point of 101° C.

The electrophotographic toners obtained in the above Examples 1 to 4 and Comparative Examples 1 to 4 were tested on the following items.

Table 1 shows the measurement results of the following test items.

(1) Offsetting-free temperature range and offsetting-free temperature width

5 Parts of an electrophotographic toner sample or a comparative electrophotographic toner and 95 parts of a ferrite carrier (trade name: DFC150S6, supplied by Douwateppun) were mixed to obtain a two-component developer. Then, the developer was used together with a commercially available copying machine (trade name: Z-133, supplied by SANYO ELECTRIC CO., LTD.) to form a strip-like unfixed image having a length of 2 cm and a width of 5 cm on each of a plurality of transfer sheets having a size of A4. Then, a fixing machine having a heat-fixing roll having a diameter of 40 mm and having a surface layer formed of a tetrafluoroethylene resin (trade name: Teflon, supplied by du Pont de Nemours & Co.) and a pressure fixing roll having a diameter of 40 mm and having a surface layer formed of silicone rubber, which were rotated together with each other, was adjusted such that the roll pressure was 1 kg/cm$^2$ and the roll speed was 200 mm/sec. While the surface temperature of the above heat fixing roll was changed stepwise, a toner image of the transfer sheet having the unfixed image was fixed at each surface temperature. In this case, it was observed whether or not the blank portion on each transfer sheet was scummed with the toner, and the temperature range in which no scumming took place was taken as an offsetting-free temperature range. Further, a difference between the maximum value and the minimum value of the offsetting-free temperature range was taken as an offsetting-free temperature width.

(2) Fixing strength

The surface temperature of the heat fixing roll of the above fixing machine was set at 130° C., and a toner image of the transfer sheet having the unfixed image was fixed. The fixed image was measured for an image density with a reflection densitometer (trade name: RD-914, supplied by Macbeth). Then, a cotton pad was rubbed against the fixed image, and the image was measured for a density in the same manner as above. A fixing strength was calculated on the basis of the measurement values according to the following equation, and was taken as an index for a low-energy toner.

Fixing strength (%)=(image density of fixed image after rubbing/image density of fixed image before rubbing)×100

TABLE 1

| | Offsetting-free temperature range (° C.) | Offsetting-free temperature width (° C.) | Fixing strength (%) | Image Density (I.D) |
|---|---|---|---|---|
| Ex. 1 | 115–230 | 115 | 87 | 1.42 |
| Ex. 2 | 120–225 | 105 | 88 | 1.44 |
| Ex. 3 | 125–230 | 105 | 85 | 1.41 |
| Ex. 4 | 110–210 | 100 | 90 | 1.43 |
| CEx. 1 | 115–145 | 30 | 89 | 1.42 |
| CEx. 2 | 120–140 | 20 | 90 | 1.44 |
| CEx. 3 | 125–160 | 35 | 87 | 1.41 |
| CEx. 4 | Offsetting was found at all temperatures | 0 | — | — |

Ex. = Example, CEx. = Comparative Example

Table 1 clearly shows that the electrophotographic toners according to the present invention caused no offsetting in the offsetting-free temperature range from low temperature to high temperature and that the offsetting-free temperature width was at least 100° C. or sufficient for practical use. The toners according to the present invention showed a fixing strength of at least 85% at a fixing temperature of 130° C., and the fixing strength was acceptable for practical use. It was found that the toners according to the present invention had excellent fixing properties at low temperatures. Further, the image density of the developed image was sufficient, and no fogging was found in those portions other than the fixed images or sufficient for practical use.

In contrast, the toners obtained in Comparative Examples showed a narrow offsetting-free temperature range and, in particular, the toner of Comparative Example 4 had no offsetting-free temperature width. Therefore, the toners obtained in Comparative Examples were not sufficient for practical use. Further, the developers containing the toners obtained in Examples, prepared in the above (1), were used for continuously making up to 10,000 copies with the same copying machine as in the above (1). As a result, in all the Examples 1 to 4, the tribocharge measured with a blow-off tribocharge measuring apparatus (supplied by Toshiba Chemical Co., Ltd.) modulated between −25 μc/g and −29 μc/g from the initial copy to 10,000th copy. The image density was maintained at a value of 1.4 or more from the initial copy to 10,000th copy in the continuous copying process. The fogging of non-image portion, measured with a color difference meter ("Z-1001DP", supplied by Nippon Denshoku Kogyo Co., Ltd.), was 0.6 or less. That is, the toners obtained in Examples 1 to 4 are acceptable in practical use. Further, when the toner was allowed to stand at 50° C. for 2 days, no blocking and no caking were found.

(Synthesis of carbodiimide-crosslinked structure-containing polyester resin)

Synthesis Example 5

A carbodiimide-crosslinked structure-containing polyester resin E was obtained in the same manner as in Synthetic Example 1 except that 5 parts of a carbodiimide compound ("Carbodilite HMV-10B", supplied by NISSHINBO INDUSTRIES, INC.) was added at the time of incorporating the monomers. The resin E had Tg of 63° C., a melting initiation temperature of 108° C. and a flow softening point of 138° C.

(Synthesis of a linear polyester resin)

Synthesis Example 6

A linear polyester resin F of a low melting point compound was obtained in the same manner as in Synthesis Example 1 except that no trimellitic anhydride was used. The resin F had Tg of 60° C., a melting initiation temperature of 85° C. and a flow softening point of 98° C.

(Synthesis of a carbodiimide crosslinked structure-containing and low melting point compound-containing polyester resin)

Synthesis Example 7

In the synthesis of the polyester resin in Synthesis Example 1, before the step of pressure reduction, 10 parts of the linear resin F obtained in Synthesis Example 6 was added, and the resultant mixture was synthesized to obtain a low melting point compound-containing polyester resin G. The resin G had Tg of 60° C., a melting initiation temperature of 96° C. and a flow softening point of 124° C.

Synthesis Example 8

In the synthesis of the carbodiimide crosslinked structure-containing polyester resin in Synthesis Example 5, before the step of pressure reduction, 1.0 part of the linear resin F obtained in Synthesis Example 6 was added, and the resultant mixture was synthesized to obtain a carbodiimide crosslinked structure-containing and low melting point compound-containing polyester resin H. The resin H had Tg of 63° C., a melting initiation temperature of 105° C. and a flow softening point of 132° C.

(Production of a toner)

Example 5

| | |
|---|---|
| Resin A obtained in Synthesis Example 1 | 50 parts |
| Carbodiimide compound ("Carbodilite HMV-8CA", supplied by NISSHINBO INDUSTRIES, INC.) | 5 parts |
| Linear polyester resin F obtained in Synthesis Example 6 | 20 parts |
| Carbon Black ("MA-100", supplied by MITSUBISHI CHEMICAL Co., LTD.) | 5 parts |
| Chromium-containing complex salt dye ("TRH", supplied by HODOGAYA CHEMICAL CO., LTD.) | 2 parts |
| Low molecular weight polypropylene ("Viscol 330P", supplied by Sanyo Chemical Industries, Ltd.) | 2 parts |

A mixture having the above components was dryblended with a super mixer and melt-kneaded under heat at a kneading temperature of 120° C., to obtain a kneaded mixture. The kneaded mixture was cooled, then pulverized and classified, to obtain negatively charged toner particles having an average particle diameter of 10 μm. 0.5 part of hydrophobic colloidal silica was externally added to 100 parts of the toner particles with a Henschel mixer, to obtain an electrophotographic toner of the present invention. The toner had Tg, measured with DSC, of 63° C., a melting initiation temperature, measured with a flow tester, of 100° C., and a flow softening point of 129° C.

Example 6

An electrophotographic toner of the present invention was obtained in the same manner as in Example 5 except that 20 parts of the linear resin F was replaced with 5 parts of carnauba wax (trade name: Carnauba wax No.1, supplied by Noda Wax Co., Ltd.). The toner had Tg of 63° C., a melting initiation temperature of 97° C. and a flow softening point of 129° C.

Example 7

An electrophotographic toner of the present invention was obtained in the same manner as in Example 5 except that 20 parts of the linear resin F was replaced with 10 parts of α-olefin/maleic anhydride copolymer (trade name: PA-30, a melting initiation temperature of 73.6° C., supplied by Mitsubishi Chemical Co., Ltd.). The toner had Tg of 62° C., a melting initiation temperature of 98° C. and a flow softening point of 127° C.

Example 8

An electrophotographic toner of the present invention was obtained in the same manner as in Example 5 except that 20 parts of the linear resin F was replaced with 5 parts of polyethylene oxide wax (trade name: High wax4202E, supplied by Mitsui kagaku). The toner had Tg of 64° C., a melting initiation temperature of 103° C. and a flow softening point of 130° C.

Example 9

| | |
|---|---|
| Resin E obtained in Synthesis Example 5 | 50 parts |
| Resin F obtained in Synthesis Example 6 | 20 parts |
| Carbon Black ("MA-600", supplied by MITSUBISHI CHEMICAL Co., LTD.) | 5 parts |
| Chromium-containing complex salt dye ("Bontron S-44", supplied by Orient Chemical Industries, Ltd.) | 2 parts |
| Low molecular weight polypropylene ("Viscol 330P", supplied by Sanyo Chemical Industries, Ltd.) | 2 parts |

An electrophotographic toner of the present invention was obtained from a mixture having the above components in the same manner as in Example 5. The toner had Tg of 62° C., a melting initiation temperature of 100° C. and a flow softening point of 128° C.

Example 10

| | |
|---|---|
| Resin G obtained in Synthesis Example 7 | 50 parts |
| Carbon Black ("MA-100", supplied by MITSUBISHI CHEMICAL CO., LTD.) | 5 parts |
| Carbodiimide compound ("Carbodilite HMV-10B", supplied by NISSHINBO INDUSTRIES, INC.) | 5 parts |
| Chromium-containing complex salt dye ("Bontron S-34", supplied by Orient Chemical Industries, Ltd.) | 2 parts |
| Low molecular weight polypropylene ("Viscol 330P", supplied by Sanyo Chemical Industries, Ltd.) | 2 parts |

An electrophotographic toner of the present invention was obtained from a mixture having the above components in the same manner as in Example 5. The toner had Tg of 63° C., a melting initiation temperature of 102° C. and a flow softening point of 128° C.

Example 11

| | |
|---|---|
| Resin H obtained in Synthesis Example 8 | 50 parts |
| Carbon Black ("MA-100", supplied by MITSUBISHI CHEMICAL CO., LTD.) | 5 parts |
| Chromium-containing complex salt dye ("Bontron S-34", supplied by Orient Chemical Industries, Ltd.) | 2 parts |
| Low molecular weight polypropylene ("Viscol 330P", supplied by Sanyo Chemical Industries, Ltd.) | 2 parts |

An electrophotographic toner of the present invention was obtained from a mixture having the above components in the same manner as in Example 5. The toner had Tg of 64° C., a melting initiation temperature of 103° C. and a flow softening point of 129° C.

Comparative Example 5

A comparative electrophotographic toner was obtained in the same manner as in Example 5 except that no carbodiimide compound was used. The toner had Tg of 60° C., a melting initiation temperature of 95° C. and a flow softening point of 120° C.

Comparative Example 6

| | |
|---|---|
| Resin F obtained in Synthesis Example 6 | 50 parts |
| Carbon Black ("MA-100", supplied by MITSUBISHI CHEMICAL CO., LTD.) | 5 parts |
| Chromium-containing complex salt dye ("Bontron S-34", supplied by Orient Chemical Industries, Ltd.) | 2 parts |
| Low molecular weight polypropylene ("Viscol 330P", supplied by Sanyo Chemical Industries, Ltd.) | 2 parts |

A comparative electrophotographic toner was obtained from a mixture having the above components in the same manner as in Example 5. The toner had Tg of 59° C., a melting initiation temperature of 84° C. and a flow softening point of 98° C.

Comparative Example 7

A comparative electrophotographic toner was obtained from the same mixture as in Example 10 except that no carbodiimide compound was used. The toner had Tg of 60° C., a melting initiation temperature of 95° C. and a flow softening point of 121° C.

The electrophotographic toners obtained in the above Examples 5 to 11 and Comparative Examples 5 to 7 were tested on the following items. Table 2 shows the results.

(1) Offsetting-free temperature range and offsetting-free temperature width

The electrophotographic toners obtained in Examples 5 to 11 and Comparative Examples 5 to 7 were tested in the same manner as in the above test of the toners of Examples 1 to 4 and Comparative Examples 1 to 4 except that the roll speed of the fixing machine was changed from 200 mm/sec to 250 mm/sec.

(2) Fixing strength

The electrophotographic toners obtained in Examples 5 to 11 and Comparative Examples 5 to 7 were tested in the same manner as in the above test of the toners of Examples 1 to 4 and Comparative Examples 1 to 4 except that the surface temperature of the heat fixing roll of the fixing machine was changed from 130° C. to 160° C.

TABLE 2

| | Resin | Carbodiimide compound | Low melting point compound | Tg (° C.) |
|---|---|---|---|---|
| Ex. 5 | Resin A | HMV-8CA (Added at a kneading time) | Resin F (Added at a kneading time) | 63 |
| Ex. 6 | Resin A | HMV-8CA (Added at a kneading time) | Carnauba wax (Added at a kneading time) | 63 |
| Ex. 7 | Resin A | HMV-8CA (Added at a kneading time) | PA-30 (Added at a kneading time) | 62 |
| Ex. 8 | Resin A | HMV-8CA (Added at a kneading time) | Polyethylene oxide wax (Added at a kneading time) | 64 |
| Ex. 9 | Resin E | HMV-10B (Added at a synthesis time) | Resin F (Added at a kneading time) | 62 |
| Ex. 10 | Resin G | HMV-10B (Added at a kneading time) | Resin F (Added at a synthesis time) | 63 |
| Ex. 11 | Resin H | HMV-10B (Added at a synthesis time) | Resin F (Added at a synthesis time) | 64 |
| CEx. 5 | Resin A | Nil | Resin F (Added at a kneading time) | 60 |
| CEx. 6 | Resin F | Nil | Nil | 59 |
| Cex. 7 | Resin G | Nil | Resin F (Added at a synthesis time) | 60 |

Offsetting- Offsetting-

TABLE 2-continued

| | Melting initiation temperature (° C.) | Flow softening point (° C.) | free temperature range (° C.) | free temperature width (° C.) | Fixing strength (%) | Image density (ID) |
|---|---|---|---|---|---|---|
| Ex. 5 | 100 | 129 | 135–230 | 95 | 72 | 1.43 |
| Ex. 6 | 97 | 129 | 130–220 | 90 | 74 | 1.42 |
| Ex. 7 | 98 | 127 | 130–220 | 90 | 78 | 1.46 |
| Ex. 8 | 103 | 130 | 140–230 | 90 | 70 | 1.44 |
| Ex. 9 | 100 | 128 | 135–225 | 90 | 72 | 1.41 |
| Ex. 10 | 102 | 128 | 140–220 | 80 | 73 | 1.42 |
| Ex. 11 | 103 | 129 | 145–230 | 85 | 72 | 1.44 |
| CEx. 5 | 95 | 120 | 130–160 | 30 | 79 | 1.42 |
| CEx. 6 | 84 | 98 | Offsetting occurred at all temperatures | 0 | — | 1.40 |
| Cex. 7 | 95 | 121 | 130–160 | 30 | 78 | 1.43 |

Ex. = Example, CEx. = Comparative Example

Table 2 clearly shows that the electrophotographic toners according to the present invention caused no offsetting in the offsetting-free temperature range from low temperature to high temperature and that the offsetting-free temperature width was at least 80° C. or sufficient for practical use. The toners according to the present invention showed a fixing strength of at least 70% at a fixing temperature of 160° C., and the fixing strength was acceptable for practical use. It was found that the toners according to the present invention had excellent fixing properties at low temperatures. Further, the image density of the developed image was sufficient, and no fogging was found in those portions other than the fixed images or sufficient for practical use.

In contrast, the toners obtained in Comparative Examples 5 to 7 showed a narrow offsetting-free temperature range and, in particular, Comparative Example 6 had no offsetting-free temperature width. Therefore, the toners obtained in Comparative Examples were not sufficient for practical use. Further, the developers containing the toners obtained in Examples, prepared in the above (1), were used for continuously making up to 10,000 copies with the same copying machine as in the above (1). As a result, in all the Examples 5 to 11, the tribocharge measured with a blow-off tribocharge measuring apparatus (supplied by Toshiba Chemical Co., Ltd.) modulated between −25 $\mu$c/g and −29 $\mu$c/g from the initial copy to 10,000th copy. The image density was maintained at 1.4 or more from the initial copy to 10,000th copy in the continuous copying process. The fogging of non-image portion, measured with a color difference meter (trade name: "Z-1001DP", supplied by Nippon Denshoku Kogyo Co., Ltd.), was 0.6 or less. That is, the toners obtained in Examples 5 to 11 are acceptable in practical use. Further, when the toner was allowed to stand at 50° C. for 2 days, no blocking and no caking were found.

What is claimed is:

1. An electrophotographic toner containing at least a binder and a colorant, wherein the binder contains a polycarbodiimide-crosslinked polyester resin having a crosslinked structure based on the reaction of a polyester resin with a polycarbodiimide resin having in its molecule a carbodiimide group shown by the following formula $$—N=C=N—.$$

2. The toner according to claim 1, wherein the polyester resin is a resin obtained from a divalent alcoholic component and at least one component selected from the group consisting of a divalent carboxylic acid, its acid anhydride and its lower alkyl ester.

3. The toner according to claim 2, wherein the polyester resin further contains at least one component selected from the group consisting of a polyvalent alcohol having 3 or more valence, a polyvalent carboxylic acid having 3 or more valence, its acid anhydride and its lower alkyl ester.

4. The toner according to claim 1, wherein the polyester resin has an acid value and a hydroxyl value of 3 mgKOH/g to 100 mgKOH/g.

5. The toner according to claim 1, wherein the polyester resin has a glass transition temperature of 50° C. or more.

6. The toner according to claim 1, wherein the polyester resin has a melting initiation temperature of 70° C. or more and a flow softening point of 100° C. or more.

7. The toner according to claim 1, wherein the polyester resin having a crosslinked structure is obtained by incorporating 0.1 to 50 parts by weight of the polycarbodiimide resin per 100 parts by weight of the polyester resin.

8. The toner according to claim 1, wherein the polyester resin having a crosslinked structure has a carbamoylamide bond and/or an isourea bond.

9. An electrophotographic toner containing at least a binder and a colorant, wherein the toner contains a carbodiimide-crosslinked polyester having a crosslinked structure based on the reaction of a polyester resin with a polycarbodiimide resin having in its molecule a carbodiimide group shown by the following formula, $$—N=C=N—,$$

and a low melting point compound having a melting initiation temperature of 60 to 100° C.

10. The toner according to claim 9, wherein the low melting point compound is waxes and/or a thermoplastic resin.

11. The toner according to claim 9, wherein the toner contains 1 to 40 parts by weight of the low melting point compound per 100 parts of the polyester resin.

12. The toner according to claim 10, wherein the waxes are an ester wax or an olefin wax.

13. The toner according to claim 12, wherein the olefin wax is a copolymer of α-olefin and a maleic anhydride and/or a maleic anhydride ester.

14. The toner according to claim 9, wherein the thermoplastic resin is a linear polyester resin obtained from a divalent alcoholic component and at least one component selected from the group consisting of a divalent carboxylic acid, its acid anhydride and its lower alkyl ester.

* * * * *